US005435062A

United States Patent [19]

Huang

[11] Patent Number: 5,435,062

[45] Date of Patent: Jul. 25, 1995

[54] ARTWORK DESIGNING GRAVITY KNIFE HAVING A BUILT-IN BLADE BOX

[76] Inventor: Yin-Han Huang, P.O. Box 1750, Taichung, Taiwan

[21] Appl. No.: 272,582

[22] Filed: Jul. 11, 1994

[51] Int. Cl.[6] ..... B26B 3/00

[52] U.S. Cl. ..... 30/125; 30/162

[58] Field of Search ..... 30/125, 163, 335, 162

[56] References Cited

U.S. PATENT DOCUMENTS 4,517,741 5/1985 Castelluzzo ..... 30/335 X 5,099,578 3/1992 Jan ..... 30/162

*Primary Examiner*—Douglas D. Watts

[57] ABSTRACT

An artwork gravity knife comprises a first handle body, a second handle body, a knife pushing mount, and a blade box. The first and the second handle bodies are pivoted respectively at the rear end thereof to a pivot such that they can be rotated in relation to each other. The first and the second handle bodies are provided respectively at the front end thereof with a knife pushing mount behind which the blade box is disposed. The blade box also serves to fasten securely the first and the second handle bodies. The blade in use can be replaced easily and safely with those which are kept in the built-in blade box.

1 Claim, 5 Drawing Sheets

ARTWORK DESIGNING GRAVITY KNIFE HAVING A BUILT-IN BLADE BOX

FIELD OF THE INVENTION

The present invention relates generally to an artwork designing gravity knife, and more particularly to an artwork designing gravity knife having a built-in blade box.

BACKGROUND OF THE INVENTION

The conventional artwork designing gravity knife is generally composed of two handle bodies, a blade mount, and a blade. The two handle bodies are provided respectively and correspondingly at the front end thereof with a moving space, a threaded hole and a pivoting hole. The two handle bodies can be rotated in relation to each other. The blade mount, which has the blade mounted thereon, disposed in the moving space before the two handle bodies are fastened together by screws engageable with the threaded holes. The knife is then ready for use in designing artwork. The conventional artwork designing gravity knife described above has inherent shortcomings, which are expounded explicitly hereinafter.

It is rather inconvenient for a user of the knife to replace the blade in view of the fact that two handle bodies are fastened together by screws, which must be loosened and tightened each time when the blade is replaced.

The blades of the conventional gravity knife are generally kept in a blade box when they are not in use. In some cases, the blades not in use are kept in a receiving space of the two handle bodies. The blades kept in the box can not be made available immediately while the blades kept in the receiving space of the handle bodies are potential safety hazards if the handle bodies of the knife are rotated improperly.

SUMMARY OF THE INVENTION

It is therefore the primary objective of the present invention to provide an artwork designing gravity knife with features capable of overcoming the above-mentioned shortcomings of the artwork designing gravity knife of the prior art.

In keeping with the principle of the present invention, the foregoing objective of the present invention is attained by an artwork designing gravity knife which is composed of a first handle body, a second handle body, a knife pushing mount, and a blade box. The first and the second handle bodies are pivoted respectively at the rear end thereof to a pivot such that they can be rotated in relation to each other. The first and the second handle bodies are provided respectively at the front end thereof with a knife pushing mount behind which the blade box is disposed. The blade box also serves to fasten securely the first and the second handle bodies. The blade in use can be easily replaced with those which are kept in the built-in blade box.

The foreging objective, features and advantages of the present invention will be more readily understood upon a thoughtful deliberation of the Following detailed description of the embodiments of the present invention in conjunction with the accompanying drawings.

DETAILED DESCRIPTION OF THE INVENTION

Figure 1:
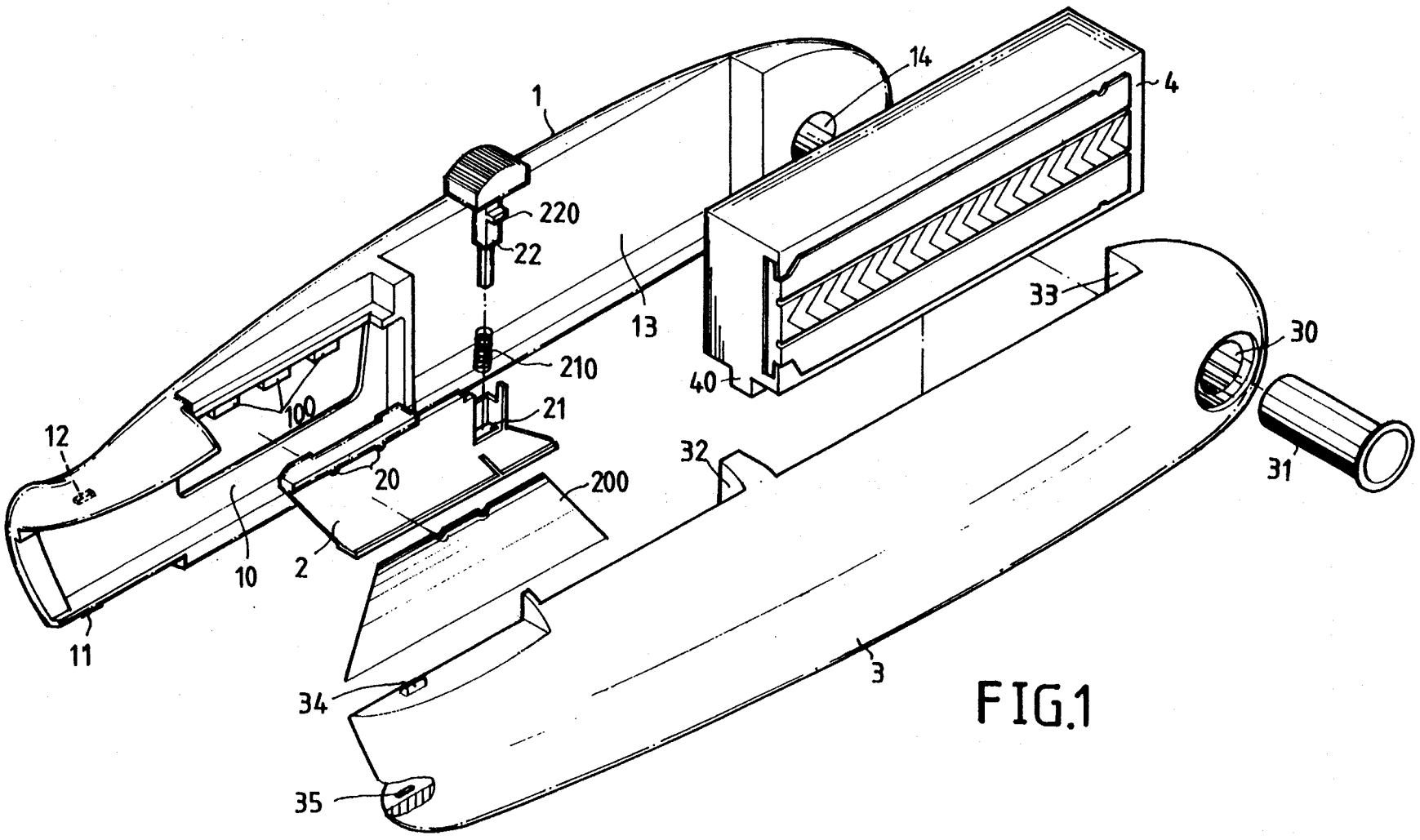
FIG. 1 shows an exploded view of an embodiment of the present invention.
Figure 2:
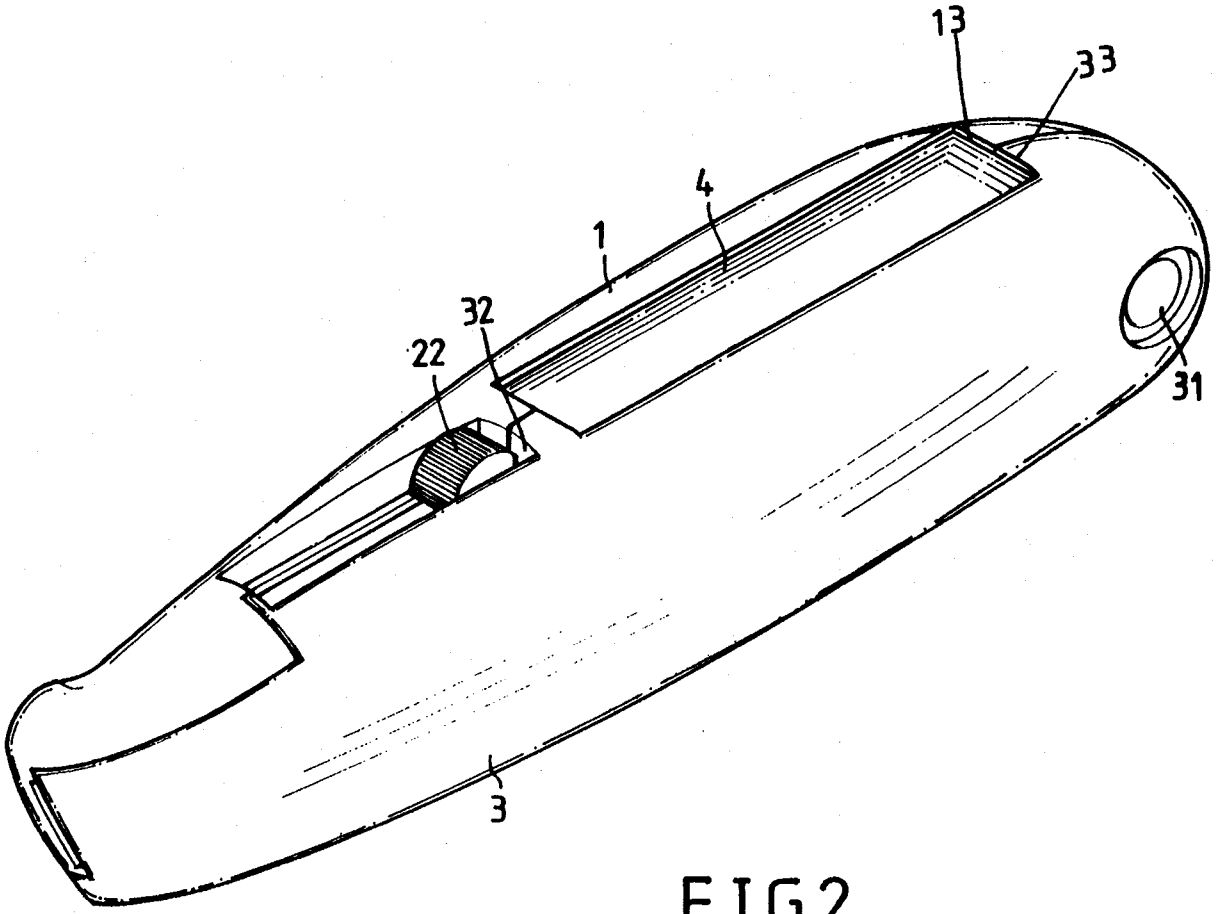
FIG. 2 shows a perspective view of the present invention.
Figure 3:
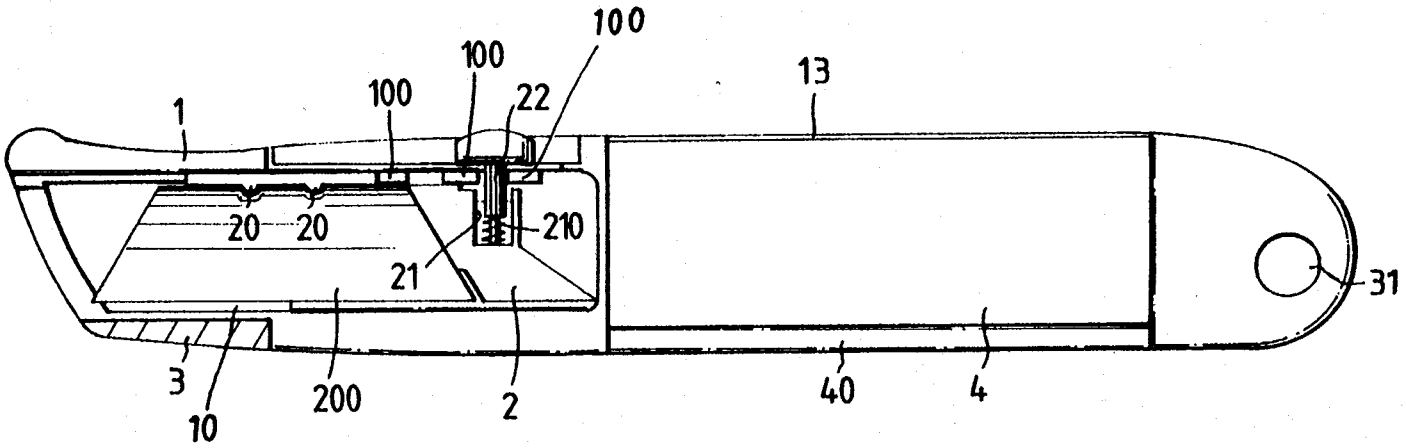
FIG. 3 shows a schematic view of the present invention.

As shown in FIGS. 1–3, the present invention comprises mainly a first handle body 1, a knife pushing mount 2, a second handle body 3, and a blade box 4.

The first handle body 1 is provided at the front end thereof with a first knife mount slot 10. In addition, the first handle body 1 is provided therein with a predetermined number of projections 100. The first knife mount slot 10 is provided respectively at both sides thereof with a retaining block 11 and a fitting hole 12. Located immediately behind the first knife mount slot 1.0 is a first receiving space 13 behind which a pivoting hole 14 is disposed.

The knife pushing mount 2 is received in the first knife mount slot 10 and is provided at the front end thereof with a predetermined number of protuberances 20 for retaining a blade 200. The knife pushing mount 2 is further provided at the rear end thereof with a receiving hole 21 in which a pushing rod 22 is disposed. The pushing rod 22 is fitted into a spring 210 and provided at one side thereof with a protruded block 220.

The second handle body 3 is provided with a pivoting hole 30 corresponding in location to the pivoting hole 14 of the first handle body 1. The pivoting hole 30 is dimensioned to receive a pivot 31. The second handle body 3 is provided with a second knife mount slot 32 and a second receiving space 33, which are respectively corresponding in location to the first knife mount slot 10 and the first receiving space 13 of the first handle body 1. The second knife mount slot 32 is provided with a fitting block 34 and a retaining hole 35, which are respectively corresponding in location to the Fitting hole 12 and the retaining block 11 of the First handle body 1.

The first handle body 1 and the second handle body 3 are joined together by the pivot 31 such that the knife pushing mount 2 can be moved in the space between the first knife mount slot 10 and the second knife mount slot 32, and that each of the protruded blocks 220 is retained in the space between the two projections 100. The knife pushing mount 2 is therefore located. There is provided a space formed by a first receiving space 13 and a second receiving space 33.

The blade box 4 is received in a space between the first receiving space 13 and the second receiving space 33 and is provided with a rib 40.

Figure 4:
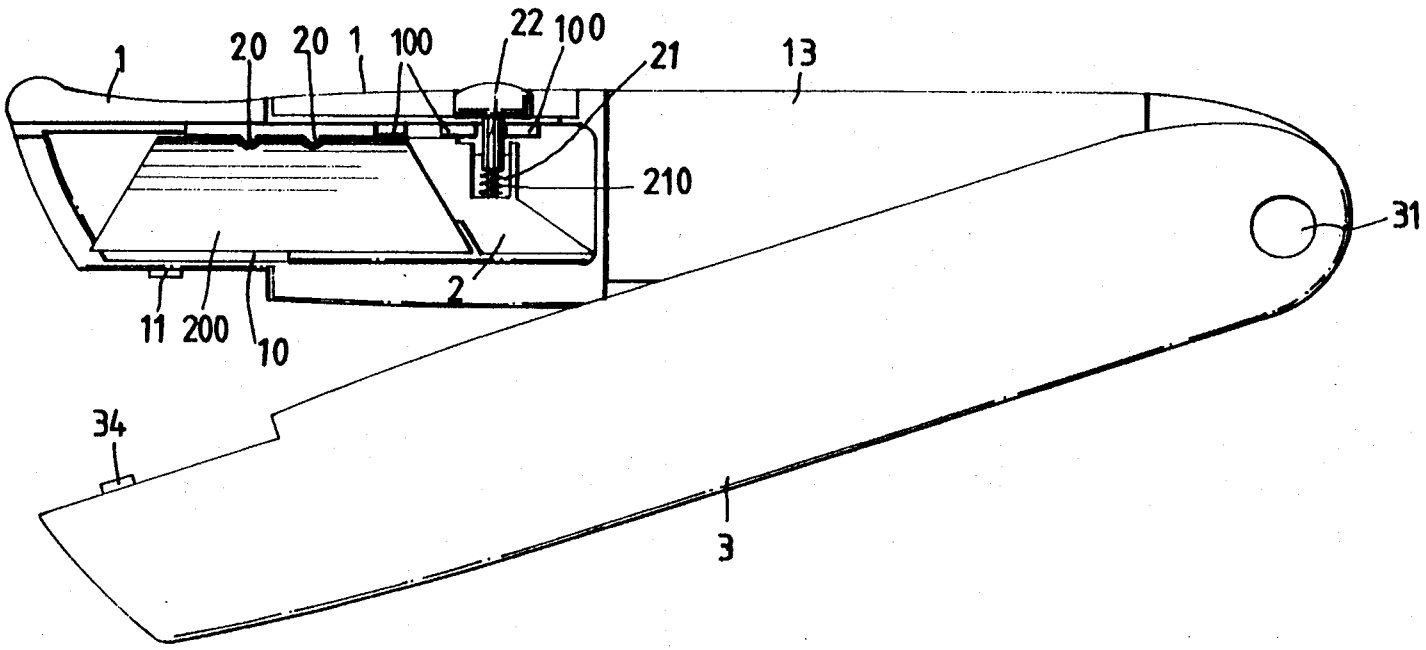
FIG. 4 shows a schematic view of the present invention in action.

As illustrated in FIGS. 2 and 4, the operation of the present invention includes a step in which the knife pushing mount 2 is mounted in the first knife mount slot 10 before the first and the second handle bodies 1 and 3 are turned on the pivot 31 such that the retaining block 11 and the fitting block 34 engage respectively the retaining hole 35 and the fitting hole 12. As a result, the first and the second handle bodies 1 and 3 are joined together securely such that a space is formed between the first receiving space 13 and the second receiving space 33. The space so formed is dimensioned to receive therein the blade box 4 which is capable of retaining the first handle body 1 and the second handle body 3. When the blade 200 is to be replaced, the rib 40 of the blade box 4 is pushed upwards so as to be taken out. Once the blade box 4 is taken out, the first handle body 1 and the second handle body 3 can be rotated on the pivot 31 so as to spread out, as shown in FIG. 4. Once the blade 200 is replaced, the first and the second handle bodies 1 and 3 are turned on the pivot 31 again so as to join together, as shown in FIG. 2. The blade box 4 is once again put back to retain the first handle body 1 and the second handle body 3, which can not be therefore rotated again.

The blades 200 contained in the blade box 4 can be removed easily and safely. In addition, the replaced blade 200 can be put back into the blade box 4 easily and safely. It is therefore readily apparent that the present invention is inherently superior to the prior art.

Figure 5:
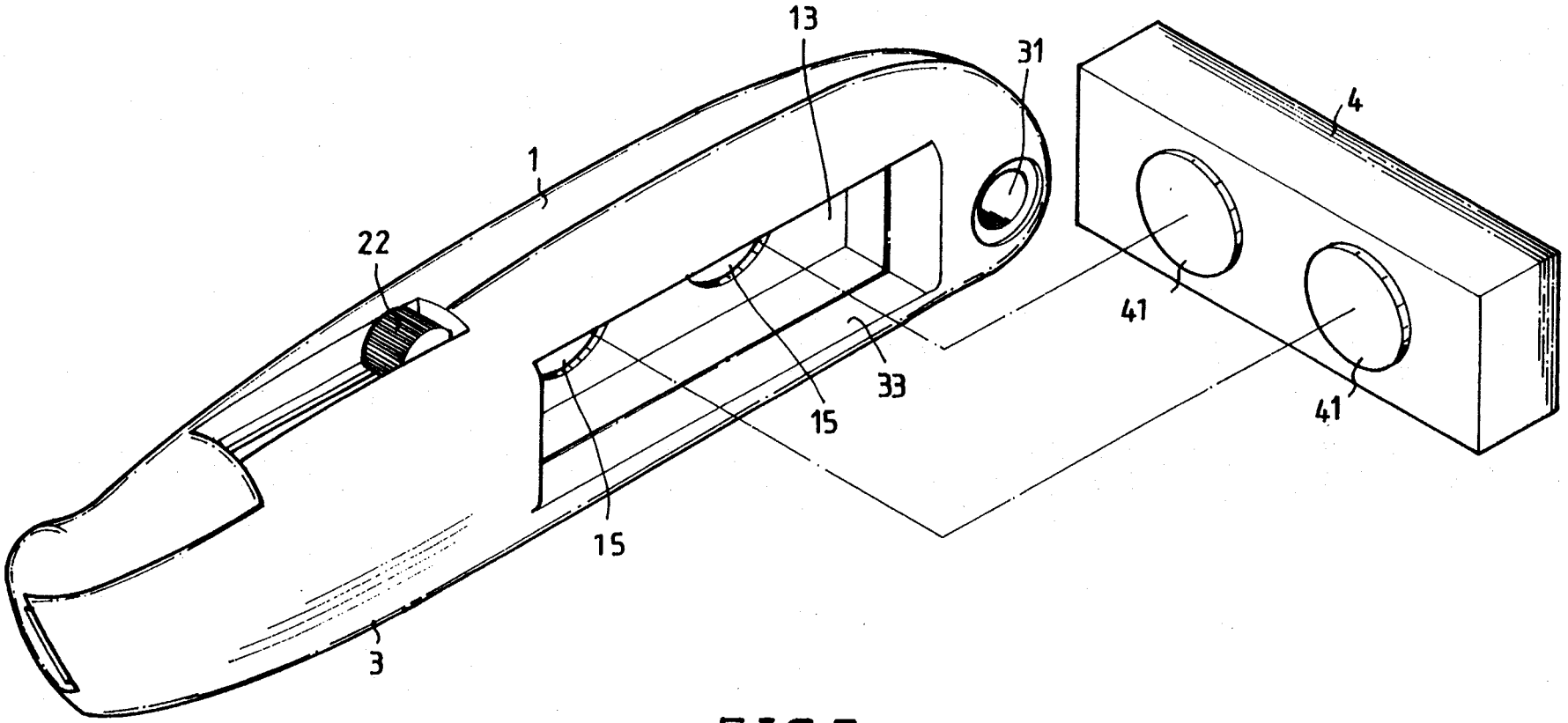
FIG. 5 shows a partial exploded view of another embodiment of the present invention.

Another embodiment of the present invention is illustrated in FIG. 5 in which either the first receiving space 13 of the first handle body 1 or the second receiving space 33 of the second handle body 3 is open in opposite sides thereof. Another modification includes two retaining holes 15 which are disposed in the first handle body 1 and are engageable with the two retaining blocks 41 of the blade box 4 at such time when the blade box 4 is placed in the receiving space 13. The blade box 4 is then located between the first handle body 1 and the second handle body 3, which are retained by the blade box 4. Once the blade box 4 is taken out, the first handle body 1 and the second handle body 3 can be rotated again.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An artwork gravity knife comprising:

a first handle body including a first knife mount slot formed therein and having two sides, a plurality of projections formed in said first knife mount slot, a first retaining block formed on one of said sides and a first retaining hole formed in the other side, said first handle body further including a first receiving space and a first pivoting hole formed therein, a second handle body including a second pivoting hole aligned with said first pivoting hole of said first handle body, a pivot pin engaged in said first and said second pivoting holes so as to pivotally couple said first and said second handle bodies together, a second knife mount slot and a second receiving space formed in said second handle body, said second knife mount slot being aligned with said first knife mount slot so as to form a third space, said second receiving space being aligned with said first receiving space so as to form a fourth space, said second knife mount slot including a second retaining block and a second retaining hole for engaging with said first retaining hole and said first retaining block respectively so as to secure said first handle body and said second handle body together, a knife pushing mount disposed in said third space formed by said first knife mount slot and including a plurality of protuberances formed thereon, and including a receiving hole formed therein, a blade secured to said knife pushing mount and engaged with said protuberances of said knife pushing mount, a pushing rod engaged in said receiving hole and including a protruded block formed thereon, a spring engaged on said pushing rod for biasing said pushing rod away from said receiving hole and for biasing said protruded block to engage between said projections of said first handle body so as to position said knife pushing mount, and a blade box for receiving blades being engaged in said fourth space formed by said first receiving space and said second receiving space and including at least one rib formed thereon, said rib being pushed for disengaging said blade box from said fourth space and for replacing blades.

* * * * *